US005556191A

United States Patent [19]

Maassen

[11] Patent Number: 5,556,191

[45] Date of Patent: Sep. 17, 1996

[54] ELECTRIC REFLECTOR LAMP

[75] Inventor: Egbertus J. P. Maassen, Eindhoven, Netherlands

[73] Assignee: U.S. Philips Corporation, New York, N.Y.

[21] Appl. No.: 400,216

[22] Filed: Mar. 7, 1995

[30] Foreign Application Priority Data

Mar. 10, 1994 [EP] European Pat. Off. ..... 94200614

[51] Int. Cl.[6] ..... F21M 3/14

[52] U.S. Cl. ..... 362/256; 362/263; 362/297; 362/308; 362/310

[58] Field of Search ..... 362/256, 260, 362/263, 296, 297, 308, 310

[56] References Cited

U.S. PATENT DOCUMENTS

| | | | |
|---|---|---|---|
| 4,729,077 | 3/1988 | Gordin et al. | 362/263 |
| 5,073,845 | 12/1991 | Aubrey | 362/260 |
| 5,119,282 | 6/1992 | Meyer et al. | 362/308 |
| 5,272,408 | 12/1993 | Levin et al. | 362/296 |
| 5,408,363 | 4/1995 | Kano . | |

FOREIGN PATENT DOCUMENTS

| | | | |
|---|---|---|---|
| 0195317 | 9/1986 | European Pat. Off. | H01K 1/32 |
| 519112A1 | 6/1991 | European Pat. Off. | F21V 7/09 |
| 2166861 | 5/1986 | United Kingdom | F21V 7/07 |

*Primary Examiner*—Denise L. Gromada
*Assistant Examiner*—Alfred Basichas
*Attorney, Agent, or Firm*—Brian J. Wieghaus

[57] ABSTRACT

The electric lamp has a lamp vessel (1) having an axis of symmetry (2) and a window (9). The lamp vessel has a first mirrored paraboloidal wall portion (5) remote from the window and a second mirrored wall portion (7) near the window. The second portion (7) is curved according to a branch (15) of a parabola, the axis (16) of which includes a sharp angle α with the axis (2) of the lamp vessel and the focus (8) of which coincides there with. The focus (8) is spaced from the focus (6) of the first wall portion (5). A cylindrical light source (10) is axially disposed in the lamp vessel (1) coincident with said foci (6,8). The lamp generates a wide beam and nevertheless has sizes which are normal for reflector lamps.

12 Claims, 1 Drawing Sheet

ELECTRIC REFLECTOR LAMP

BACKGROUND OF THE INVENTION

The invention relates to an electric reflector lamp comprising:

a lamp vessel having an axis of symmetry and a neck-shaped lamp vessel portion which supports a lamp cap at a free end thereof, said lamp vessel having a first parabolically curved, reflectorized wall portion which merges into the neck-shaped wall portion and which has a first focus substantially on the axis of symmetry, and a second parabolically curved, reflectorized wall portion which has a second focus substantially on the axis of symmetry, and said lamp vessel being closed off with a light-transmitting window opposite the neck-shaped wall portion;

a substantially linear electric light source with a geometric center, axially arranged in the lamp vessel in the first and the second focus;

current conductors connecting the light source to the lamp cap.

Such a reflector lamp is known from EP 0 195 317. In the known lamp, the first and the second focus coincide, and the geometric center of the light source lies in said focuses. Radiation incident on the first reflectorized wall portion is so reflected for a major portion that it cannot issue to the outside until after it has been reflected once more. Light is lost, however, upon each reflection because no reflector material will reflect 100% of the incident light. Multiple reflections are accordingly disadvantageous for the useful output of a lamp. Another disadvantage of the known lamp is that the lamp provides a comparatively narrow beam when the light source is positioned axially.

A wider beam is indeed obtained when the described possibility of positioning the light source transversely is used in the known lamp, but this beam has the disadvantage that it is not rotationally symmetrical. An axial, linear light source is particularly suitable for that purpose. It is possible to obtain a wide beam with an axial light source, but then the lamp vessel must necessarily be comparatively wide, as is the case in lamps made of moulded glass such as PAR38 lamps. The lamp vessel there has a greatest width of 11 to 12 cm. This width differs strongly from that of reflector lamps having a blown lamp vessel and from the width of luminaires designed for them, which usually is 60 to 95 mm.

GB 2 166 861 A discloses an electric reflector lamp wherein a reflectorized paraboloidally curved portion merges into the neck-shaped lamp vessel portion, and merges via a reflectorized spherical portion into a second reflectorized paraboloidally curved portion. The focuses and the center of curvature of the reflectorized portions coincide. An incandescent body is positioned transversely in the focal plane. The spherical portion provides double reflections. The transverse incandescent body renders the beam non-rotationally-symmetrical.

SUMMARY OF THE INVENTION

It is an object of the invention to provide an electric reflector lamp of the kind described in the opening paragraph which yields a comparatively wide, substantially rotationally symmetrical beam of high uniformity, while multiple reflections are counteracted.

According to the invention, this object is achieved in that the first reflectorized wall portion is a paraboloid having a first axis which coincides with the axis of the lamp vessel, the second reflectorized wall portion is a body of revolution of a branch of a parabola having a second axis which encloses an acute angle $\alpha$ with the axis of the lamp vessel, and the first and the second focus are separate from one another.

In the reflector lamp according to the invention, the first reflectorized paraboloidal wall portion shapes the light originating from its focus and the immediate surroundings thereof into a light beam which illuminates a central portion of a field to be illuminated. The second reflectorized wall portion shapes the light originating from its focus and the immediate surroundings thereof into an annular beam which illuminates an annular portion around the center of the field to be illuminated. Thus a comparatively wide up to very wide beam and a comparatively large up to very large illuminated field may be obtained, while nevertheless the lamp has a length and greatest diameter which are conventional. The greatest diameter of the lamp is in fact smaller than if the parabola branch were not tilted so as to have the second axis enclose an angle $\alpha$ with the axis of the lamp vessel.

The reflector lamp may provide a wide up to very wide light beam, for example of 30° to 70°, depending on the choices made therein, with a gradual decrease in luminous intensity.

The light source is usually designed for operation at mains voltage, for example 110 or 240 V, and may be, for example, an incandescent body which is possibly accommodated in an inner envelope which is filled, for example, with an inert gas comprising halogen. Alternatively, the light source may be a high-pressure gas discharge, for example a high-pressure sodium discharge, for example between tungsten electrodes in a discharge vessel of monocrystalline or polycrystalline aluminium oxide, or a high-pressure mercury discharge, possibly with metal halide, or a high-pressure xenon discharge, for example between tungsten electrodes in a discharge vessel made of quartz glass or aluminium oxide. The axial dimension of the light source may vary within wide limits and may lie, for example, between 10 and 30 mm in the case of a 80-mm window diameter. The axial dimension of the light source may be much larger, e.g. 10 times or even more, than the dimensions transverse to the axis. All other lamp parameters remaining the same, a lamp having a long light source will give a wider beam than a lamp having a short light source. When the light source is comparatively short, the window may be chosen to be comparatively small.

A light source, such as a metal halide discharge, in a light-diffusing discharge vessel of e.g. polycrystalline aluminium oxide behaves in the reflector lamp as a light source which has the length of the outside axial dimension of the discharge vessel and a transverse dimension of about two times the thickness of its electrodes.

Since the focuses lie separately from one another on the light source, the length of the chosen light source limits the interspacing of the focuses. In general, however, the distance between the focuses is 5 mm up to ⅔ of the light source length. The focuses may lie substantially at equal distances from the geometric center of the light source. The light source then has a first longitudinal portion around the first focus, which is surrounded by the first reflectorized wall portion over a comparatively great spatial angle, and a second longitudinal portion around the second focus, which is surrounded by the second reflectorized wall portion over a comparatively great spatial angle. Alternatively, the light source may be shifted relative to the focuses towards the window, whereby the beam is widened, or away from the window, whereby the beam is narrowed.

When the second axis of the second reflectorized wall portion encloses a comparatively small acute angle α with the lamp vessel axis, then the annular beam has a smaller diameter than when the angle α is greater. The angle α lies in the region from 18 to 30° in many embodiments of the reflector lamp. As a rule the angle α lies in the range of 20°–25°.

The reflectorized wall portions may merge into the relevant adjacent wall portions each time imperceptibly to the human eye, or alternatively via a kink in the lamp vessel contour.

The light distribution in the beam formed by the lamp may be further influenced by the relative size of the first wall portion. In case a lamp produces a light beam of comparatively small width, comparatively much light is thrown onto a central portion of the field to be illuminated and in case a lamp produces a light beam of comparatively great width, comparatively little light. The relative size of the first wall portion may be expressed in terms of the apparent size $S_1$ of that wall portion compared with the apparent size $S_t$ of the total of the reflectorized wall portions. The term "apparent size" is understood to mean the surface area of the perpendicular projection in a plane perpendicular to the axis of the lamp vessel. In a reflector lamp with a light beam of comparatively small width, $S_1$ may then be approximately 0.3 $S_t$, in a reflector lamp of great width approximately 0.2 $S_t$.

The lamp vessel of the electric reflector lamp may be a blown lamp vessel, in which case the lamp vessel portions are integral, or alternatively be built up from a first mirror-coated reflector portion and a second portion which serves as a window portion. These portions are then each made, for example, from moulded glass and are fastened to one another, for example, by fusion, with cement, or with glass enamel.

A current conductor must extend alongside the light source back to the lamp cap in order to supply the electric light source. This current conductor may cause an inhomogeneity in the beam if it is comparatively thick. It is also possible with a discharge as the light source that light from the center of the discharge has a higher colour temperature, and accordingly a different colour compared with light from the periphery of the discharge. It is favourable therefore when the window has a light-scattering or light-spreading effect, and consequently a light-mixing effect. The window may be, for example, frosted or satin-finished, as is usual in many reflector lamps, or may have a surface structure, for example, of rounded prisms. Such a window has the advantage that it prevents observation of high luminances of the light source and the reflectorized portions. Instead, or in addition, reflectorized wall portions may have a non-smooth surface. The mirror coating may be provided on a rough, for example frosted or satin-finished surface.

The reflectorized wall portions may have a layer of aluminium, silver, or gold, or a combination thereof, or a light-reflecting interference mirror.

Axial lanes may be superimposed on the fundamental shape of reflectorized wall portions, for example lanes which are plane in transverse direction, especially in the electric reflector lamp having a first reflectorized lamp vessel portion which is fastened to a second window portion and is made, for example, of moulded glass. The second reflectorized wall portion may have a greater number of such lanes, because of its greater circumference, than does the first portion. The lanes spread the light reflected by the relevant wall portion. In a lamp having a comparatively large apparent surface area of the first reflectorized wall portion, which would cause a comparatively strong illumination of a central field portion, the effect of said first wall portion on the central field portion is reduced by such lanes in favour of a stronger illumination of an annular zone around the central portion.

BRIEF DESCRIPTION OF THE DRAWINGS

Embodiments of the electric reflector lamp according to the invention are shown in the drawing, in which.

Figure 1:
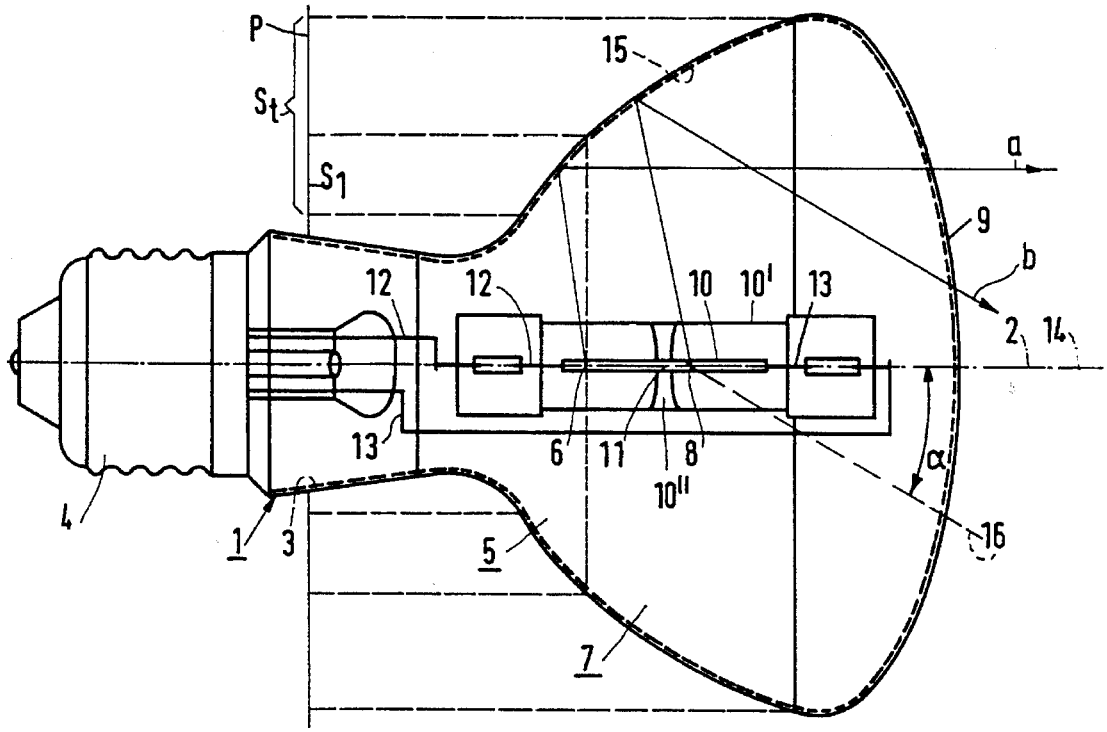
FIG. 1 shows a first embodiment, partly in axial section, partly in side elevation.

The electric reflector lamp in FIG. 1 has an axis of symmetry 2 and a neck-shaped lamp wall portion 3 which supports a lamp cap 4 at a free end thereof. The lamp vessel has a first parabolically curved, reflectorized wall portion 5 which merges into the neck-shaped wall portion 3 and which has a first focus 6 substantially on the axis of symmetry. The lamp vessel also has a second parabolically curved, reflectorized wall portion 7 with a second focus 8 substantially on the axis of symmetry. A light-transmitting window 9 opposite the neck-shaped wall portion 3 closes off the lamp vessel.

A substantially linear electric light source 10 with a geometric center 11 is arranged axially in the lamp vessel on the first 6 and the second focus 8. Current conductors 12, 13 connect the light source 10 to the lamp cap 4.

The first reflectorized wall portion 5 is a paraboloid with a first axis 14 which coincides with the axis 2 of the lamp vessel 1. The second reflectorized wall portion 7 is a body of revolution of a branch 15 of a parabola with a second axis 16 which encloses an acute angle α with the axis 2 of the lamp vessel 1. The first 6 and the second focus 8 are separate from one another.

The light source in the Figure is a helical double-coiled linear incandescent body in an inner envelope 10' made of, for example, quartz glass and filled with an inert gas containing hydrogen bromide. The incandescent body is supported between its ends by dimples in the inner envelope. The lamp vessel 1 has a satin-frosted inner surface so that the window 9 is light-scattering. The possibility of looking into components of high luminance is counteracted thereby, as is a shadow effect of the current conductor 13. The roughened surface of the lamp vessel on which the mirror coating of the reflectorized wall portions, an aluminium layer in the Figure, is provided also contributes to the latter.

The second axis 16 encloses an angle α of 25° with the axis 2 in the Figure. The light ray a originating from the focus 6 of the first reflectorized wall portion 5 is reflected parallel to the axis 2 by the first reflectorized wall portion. The light ray b originating from the focus 8 of the second reflectorized wall portion 7 is reflected parallel to its axis 16 by the second reflectorized wall portion. Rays a and rays in a beam surrounding it illuminate a central portion of a field, whereas rays b and rays in a beam surrounding it illuminate an annular field around said central portion.

In the Figure, the parabola of the first reflectorized wall portion has a focal distance of 13 mm, the parabola branch of the second reflectorized wall portion a focal distance of 27 mm. The focuses 6 and 8 lie approximately 12 mm apart, i.e. a distance half the length of the 24 mm long incandescent body. In the Figure, the apparent surface area $S_1$ of the first reflectorized wall portion is 0.3 $S_t$. The angle α lies in the region from 18° to 30°, and is 25°. The lamp shown consumes a power of 75 W at 230 V and has a greatest diameter of 80 mm. The lamp provides a substantially rotationally symmetrical light beam of high homogeneity, while multiple reflections in the lamp are counteracted. The beam formed has a half-value width of 30°. This value may be made larger by shifting the light source towards the window 9.

Figure 2:
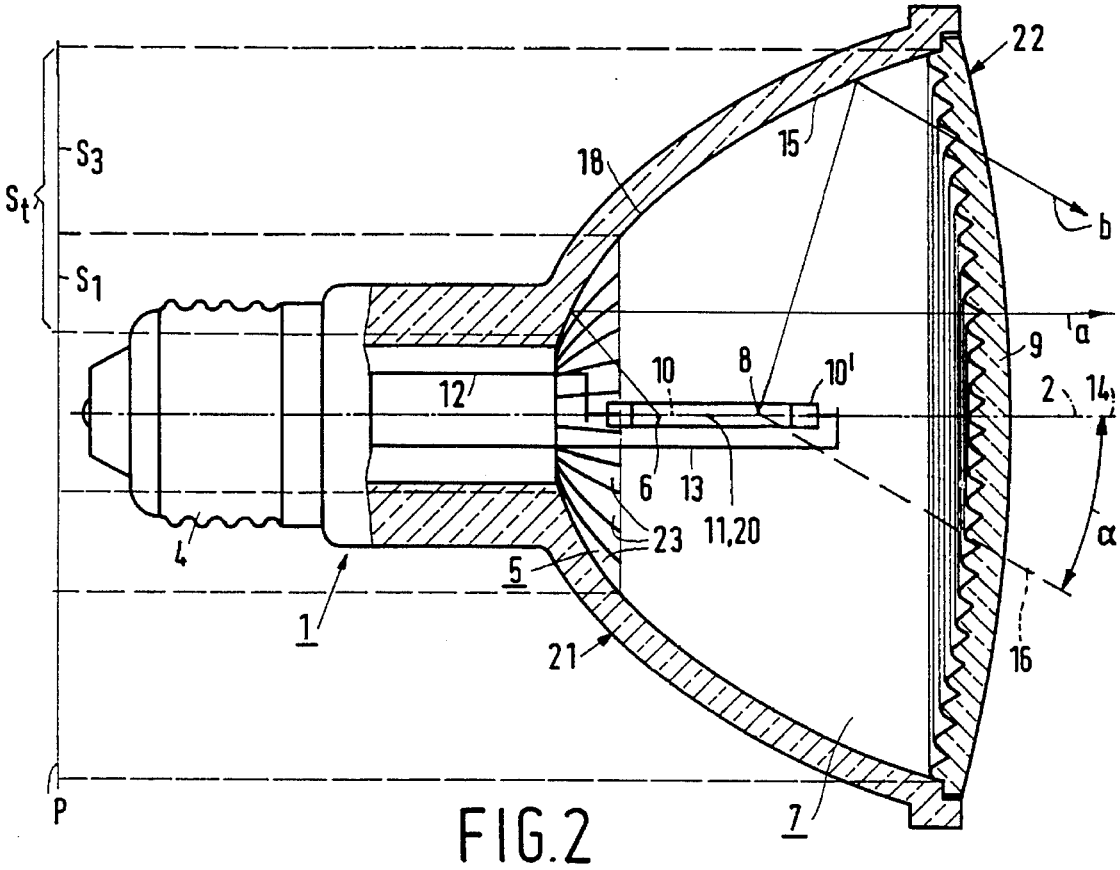
FIG. 2 shows a second embodiment, partly in axial section, partly in side elevation.

In FIG. 2, components corresponding to components in FIG. 1 have the same reference numerals as in FIG. 1.

The light source 10 in the Figure is a high-pressure sodium vapour discharge which radiates white light and has an envelope of sintered aluminium oxide.

The reflectorized wall portions 5, 7 of the lamp vessel 1 are fastened as a first part 21 of the lamp vessel to a second part 22 of the lamp vessel which comprises the window 9. This embodiment is particularly useful in case there is a risk that the discharge vessel may explode. The second part 22 has rings of rounded prisms. The second part may spread the light over e.g. 20°, 30° or 40°.

Axial lanes 23 which are plane in transverse direction are superimposed on the first reflectorized wall portion. Such lanes may also be superimposed on the second reflectorized wall portion 7, for example, in a greater number.

The lamp provides a light beam with a half-value width of 40°. This width may vary between 30° and 70° depending on the position of the light source and the spreading action of the window if the window has such action.

As it is apparent from the Figures, reflected light will hardly pass through a circumferential zone of the window. As a result, the lamp may be operated rather deeply recessed in a luminaire without substantial loss of bundled light.

I claim:

1. An electric reflector lamp, comprising:

a lamp vessel defining an axis of symmetry and having
(i) a neck-shaped lamp wall portion,
(ii) a first parabolically curved, reflectorized wall portion which merges into the neck-shaped wall portion and has a first focus substantially on the axis of symmetry,
(iii) a second parabolically curved, reflectorized wall portion which has a second focus substantially on the axis of symmetry, and
(iv) a light-transmitting window opposite the neck-shaped wall portion;

a substantially linear electric light source with a geometric center, axially arranged in the lamp vessel in the first and the second focus; and current conductors connecting the light source to the exterior of the lamp vessel, characterized in that
the first reflectorized wall portion is a paraboloid having a first axis which coincides with the axis of the lamp vessel,
the second reflectorized wall portion is a body of revolution of a branch of a parabola having a second axis which does not coincide with the axis of the lamp vessel and which encloses an acute angle α with the axis of the lamp vessel, and
the first and the second focus are separate from one another.

2. An electric reflector lamp as claimed in claim 1, characterized in that the surface area $S_1$ of the first reflectorized wall portion projected perpendicularly in a plane (P) perpendicular to the axis of the lamp vessel is 0.2 to 0.3 $S_t$, $S_t$ being the total surface area of the perpendicular projection of the reflectorized wall portions.

3. An electric reflector lamp as claimed in claim 1, characterized in that the angle α lies in the region from 18° to 30°.

4. An electric reflector lamp as claimed in claim 1 or 2, characterized in that the window is light-scattering.

5. An electric reflector lamp as claimed in claim 1 or 2, characterized in that the reflectorized wall portions have a rough surface.

6. An electric reflector lamp as claimed in claim 1 or 2, characterized in that the lamp vessel comprises first and second parts fastened to each other, the first part comprising the first and second reflectorized wall portions of the lamp vessel and the second part comprising a window.

7. A reflector for an electric lamp, comprising:

a reflector body defining an axis of symmetry and having
(i) a neck-shaped lamp wall portion,
(ii) a first parabolically curved, reflectorized wall portion which merges into the neck-shaped wall portion and has a first focus substantially on the axis of symmetry,
(iii) a second parabolically curved, reflectorized wall portion which has a focus substantially on the axis of symmetry, and
(iv) a light-transmitting window opposite the neck-shaped wall portion;

the first reflectorized wall portion being a paraboloid having a first axis which coincides with the axis of the lamp vessel, the second reflectorized wall portion being a body of revolution of a branch of a parabola having a second axis which does not coincide with the axis of the lamp vessel and encloses an acute angle α with the axis of the lamp vessel, and the first and the second focus are separate from one another.

8. A reflector for an electric lamp as claimed in claim 7, characterized in that the surface area $S_1$ of the first reflectorized wall portion projected perpendicularly in a plane (P) perpendicular to the axis of the lamp vessel is 0.2 to 0.3 $S_t$, $S_t$ being the total surface area of the perpendicular projection of the reflectorized wall portions.

9. A reflector for an electric lamp as claimed in claim 8, characterized in that the angle α lies in the region from 18° to 30°.

10. A reflector for an electric lamp as claimed in claim 7, characterized in that the reflectorized wall portions have a rough surface.

11. A reflector for an electric lamp as claimed in claim 7, characterized in that the angle α lies in the region from 18° to 30°.

12. An electric reflector lamp, comprising:

(a) a lamp vessel defining an axis of symmetry and having
(i) a neck-shaped lamp wall portion;
(ii) a first parabolically curved, reflectorized wall portion which merges into the neck-shaped wall portion and has a first focus substantially on the axis of symmetry,
(iii) a second parabolically curved, reflectorized wall portion which has a second focus substantially on the axis of symmetry, and
(iv) a light-transmitting window opposite the neck-shaped wall portion;

(b) a substantially linear electric light source axially arranged in the lamp vessel in the first and the second focus; and (c) current conductors connecting the light source to the exterior of the lamp vessel, the first reflectorized wall portion being a paraboloid having a first axis which coincides with the axis of the lamp vessel and shapes the light from said light source emanating from said first focus and the immediate surrounding of the first-focus into a light beam which illuminates a central portion of a field illuminated by the reflector lamp, the second reflectorized wall portion being a body of revolution of a branch of a parabola having a second axis which is not coincident with the axis of the lamp vessel and which encloses an acute angle $\alpha$ with the axis of the lamp vessel and shapes the light from said light-source emanating from said second focus and the immediate surroundings of said second focus into an annular light beam which illuminates an annular portion around the center of the field illuminated by the beam from said first reflectorized wall portion, and the first and the second focus are separate from one another.

* * * * *